US012279740B2

(12) United States Patent
Zhong et al.

(10) Patent No.: US 12,279,740 B2
(45) Date of Patent: Apr. 22, 2025

(54) STORAGE BASE AND VACUUM CLEANER ASSEMBLY HAVING SAME

(71) Applicants: JIANGSU MIDEA CLEANING APPLIANCES CO., LTD., Suzhou (CN); MIDEA GROUP CO., LTD., Foshan (CN)

(72) Inventors: Min Zhong, Suzhou (CN); Tom Ford, Suzhou (CN); Xuebing Yin, Suzhou (CN); Yuanfu Xu, Suzhou (CN); Jingying Guo, Suzhou (CN); Xia Xu, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 332 days.

(21) Appl. No.: 17/775,874

(22) PCT Filed: Sep. 3, 2020

(86) PCT No.: PCT/CN2020/113173

§ 371 (c)(1),
(2) Date: May 10, 2022

(87) PCT Pub. No.: WO2021/103730

PCT Pub. Date: Jun. 3, 2021

(65) Prior Publication Data

US 2022/0386835 A1 Dec. 8, 2022

(30) Foreign Application Priority Data

Nov. 29, 2019 (CN) ..... 201911207051.0

(51) Int. Cl.
*A47L 9/00* (2006.01)
*A47L 5/28* (2006.01)

(52) U.S. Cl.
CPC ..... *A47L 9/0063* (2013.01); *A47L 5/28* (2013.01)

(58) Field of Classification Search
CPC ..... A47L 9/0063; A47L 5/28
See application file for complete search history.

(56) References Cited

FOREIGN PATENT DOCUMENTS

| | | | | | |
|---|---|---|---|---|---|
| CN | 107997677 | A | * | 5/2018 | ..... A47L 9/0063 |
| CN | 108433640 | A | | 8/2018 | |
| CN | 109381118 | A | * | 2/2019 | ..... A47L 9/00 |
| CN | 208551646 | U | | 3/2019 | |
| CN | 208598276 | U | | 3/2019 | |

(Continued)

OTHER PUBLICATIONS

JP-2018126396-A—English Machine Translation (Year: 2018).*

(Continued)

*Primary Examiner* — Marc Carlson

(57) ABSTRACT

Provided are a storage base and a vacuum cleaner assembly having the same. The storage base is configured to store a vacuum cleaner. The storage base includes a first component connecting portion configured to store a first component of the vacuum cleaner and a second component storage portion configured to store a second component of the vacuum cleaner. The first component connecting portion and the second component storing portion are staggered with each other in a circumferential direction of the storage base.

9 Claims, 7 Drawing Sheets

(56) References Cited

FOREIGN PATENT DOCUMENTS

| | | | | | |
|---|---|---|---|---|---|
| CN | 208837795 | U | | 5/2019 | |
| CN | 209236018 | U | | 8/2019 | |
| CN | 110403526 | A | * | 11/2019 | |
| CN | 211130859 | U | | 7/2020 | |
| JP | 2002000526 | A | | 1/2002 | |
| JP | 2003047577 | A | | 2/2003 | |
| JP | 2018126396 | A | * | 8/2018 | |
| KR | 20010070633 | A | * | 7/2001 | |
| WO | WO-2020045813 | A1 | * | 3/2020 | ..... A47L 5/28 |

OTHER PUBLICATIONS

CN-110403526-A—English Machine Translation (Year: 2019).*
International Search Report of PCT No. PCT/CN2020/113173.
First OA received in CN Application No. 201911207051.0; mailed Sep. 23, 2024.

* cited by examiner

STORAGE BASE AND VACUUM CLEANER ASSEMBLY HAVING SAME

CROSS-REFERENCES TO RELATED APPLICATIONS

The present disclosure is a national phase application of International Application No. PCT/CN2020/113173, filed on Sep. 3, 2020, which claims priority to Chinese Patent Application No. 201911207051.0, filed on Nov. 29, 2019, the entireties of which are herein incorporated by reference.

FIELD

The present disclosure relates to the field of household appliance technologies, and more particularly, to a storage base and a vacuum cleaner assembly having the same.

BACKGROUND

Hand-held vacuum cleaners have been more and more popular with consumers due to its small size, easy to carry and use. However, the current hand-held vacuum cleaner is inconvenient for storage after use. In addition, a cleaner main body and a floor brush assembly are not placed neatly and are easy to be lost after being disassembled.

SUMMARY

Embodiments of the present disclosure are intended to solve at least one of the problems in the related art to at least some extent. To this end, the present disclosure provides a storage base, which is convenient to well storing a hand-held vacuum cleaner when not in use.

The present disclosure also provides a vacuum cleaner assembly having the storage base as described above.

The storage base according to embodiments of the present disclosure is configured store a vacuum cleaner. The storage base includes a first component connecting portion configured to store a first component of the vacuum cleaner, and a second component storage portion configured to store a second component of the vacuum cleaner. The first component connecting portion and the second component storage portion are staggered with each other in a circumferential direction of the storage base.

In the storage base according to the embodiments of the present disclosure, by arranging the first component connecting portion and the second component storage portion on the storage base, the first component and the second component of the vacuum cleaner can be accommodated on the storage base when the vacuum cleaner is not in use. In addition, the first component connecting portion and the second part storage portion are staggered with each other. Thus, components of can be conveniently stored.

According to some embodiments of the present disclosure, the storage base also includes: a storage base body, the second component storage portion being disposed on the storage base body; and a storage base pillar disposed on the storage base body. The first component connecting portion is disposed on the storage base pillar, and the second component storage portion and the first component connecting portion are arranged on opposite sides of the storage base pillar in a circumferential direction of the storage base pillar.

According to some embodiments of the present disclosure, the storage base also includes a support locking member provided thereon. The support locking member is located above the second component storage portion.

Further, the second component has a component locking member provided thereon. The component locking member is adapted to be engaged with the support locking member in response to the second component being lifted upwards.

Alternatively, the support locking member is a wedge-shaped locking member matching with the component locking member in shape.

According to some embodiments of the present disclosure, the first component connecting portion is formed as an insertion pin extending obliquely upwards, and the second component storage portion is formed as a concave surface recessed downwards.

According to some embodiments of the present disclosure, the first component is a cleaner main body and the second component is a floor brush assembly. The floor brush assembly is detachably connected to the cleaner main body, and the second component storage portion is formed as a floor brush concave surface matching with the floor brush assembly.

Specifically, the floor brush assembly includes a floor brush body and an extension pipe. The cleaner main body has a suction pipe adapted to match with the extension pipe. The suction pipe extends downwards when the cleaner main body is stored on the storage base.

Alternatively, the suction pipe is adapted to be brought into contact with a floor when each of the cleaner main body and the floor brush assembly is stored on the storage base.

According to embodiments of the present disclosure, a vacuum cleaner assembly is provided. The vacuum cleaner includes a vacuum cleaner and the storage base as described above.

Further, the vacuum cleaner includes a cleaner main body, and a floor brush assembly configured to be engaged with the cleaner main body. The floor brush assembly includes a floor brush body and an extension pipe. The storage base is configured to drive, in response to a top portion of the extension pipe being lifted upwards, the cleaner main body to move upwards while being out of contact with the floor.

and the description thereof will be omitted herein

Additional of the embodiments of the present disclosure will be provided at least in part in the following description, or become apparent at least in part from the following description, or can be learned from practicing of the present disclosure.

Figure 1:
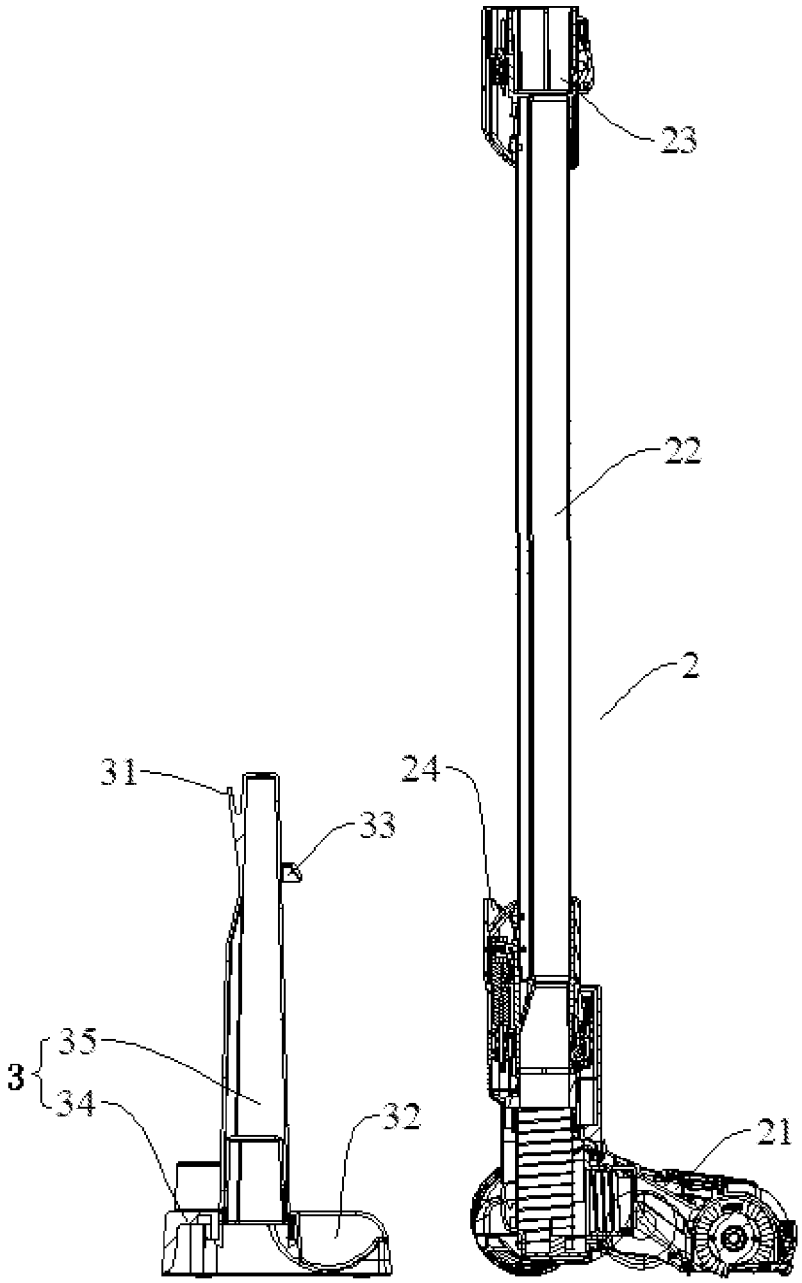
FIG. 1 is a schematic exploded view showing a floor brush assembly and a storage base.
Figure 2:
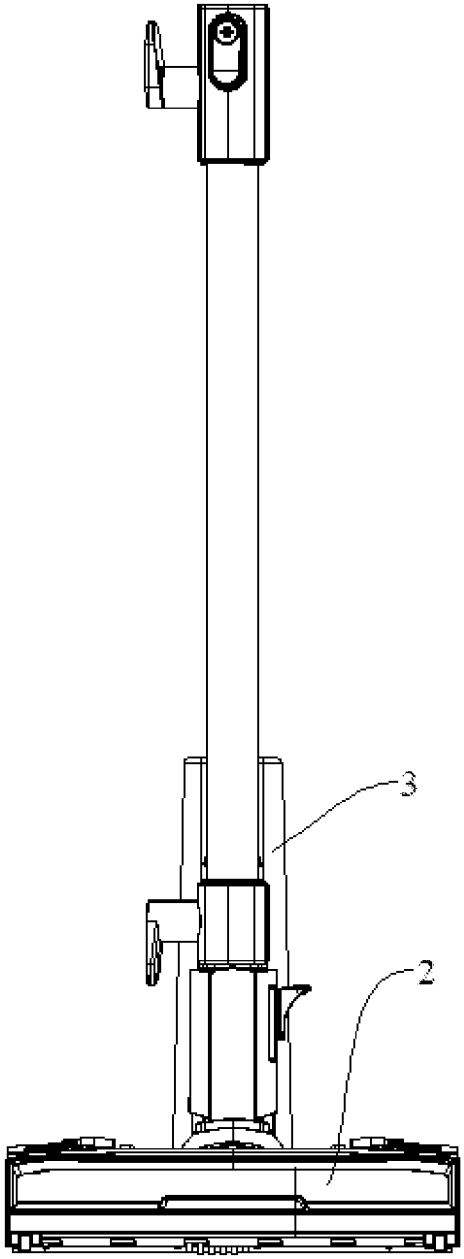
FIG. 2 is a right side view of FIG. 1.

REFERENCE SIGNS vacuum cleaner assembly 10, cleaner main body (first component) 1, suction pipe 11, groove 12, support arm 13, floor brush assembly (second component) 2, floor brush body 21, extension pipe 22, extension pipe coupler 23, component locking member 24, storage base 3, main body connection portion (first component connecting portion) 31, floor brush storage portion (second component storage portion) 32, support locking member 33, storage base body 34, storage base pillar 35

DETAILED DESCRIPTION OF THE DISCLOSURE

Embodiments of the present disclosure are described below in detail, examples of the embodiments are shown in accompanying drawings, and throughout the description, the same or similar reference signs represent the same or similar components or the components having the same or similar functions. The embodiments described below with reference to the accompanying drawings are exemplary and merely used to explain the present disclosure, rather than being construed as limitation on the present disclosure.

In the description of the present disclosure, it should be understood that the orientation or position relationship indicated by the terms "longitudinal", "transverse", "length", "width", "thickness", "upper", "lower", "front", "rear", "left", "right", "vertical", "horizontal", "top", "bottom", "inner", "outer", etc., is based on the orientation or position relationship shown in the drawings, and is merely for the convenience of describing the present disclosure and simplifying the description, rather than indicating or implying that the defined device or element must have a specific orientation or must be constructed and operated in a specific orientation. Thus, the orientation or position relationship indicated by these terms cannot be understood as limitations on the present disclosure.

In addition, the terms "first" and "second" are merely used for purpose of description, and cannot be understood as indicating or implying relative importance or implicitly indicating the number of indicated features. Therefore, the features defined by the terms "first" and "second" may explicitly or implicitly include at least one of the features. In the description of the present disclosure, "plurality" means at least two, unless otherwise specifically defined.

In the description of the present disclosure, it should be noted that, unless otherwise clearly specified and defined, terms such as "install", "mount", "connect to", "connected with" and the like should be understood in a broad sense. For example, it may be a fixed connection or a detachable connection or integral connection; mechanical connection or electrical connection or mutual communication; direct connection or indirect connection by an intermediate; internal communication of two components or an interaction relationship between two components. The specific meaning of the above-mentioned terms in the present disclosure can be understood according to specific circumstances.

A storage base 3 according to embodiments of the present disclosure will be described in detail with reference to FIG. 1 to FIG. 9.

As illustrated in FIG. 1 and FIG. 7 to FIG. 9, the storage base 3 according to the embodiments of the present disclosure is configured to store a vacuum cleaner. The storage base 3 includes a first component connecting portion 31 and a second component storage portion 32. The first component connecting portion 31 is configured to store a first component 1 of the vacuum cleaner, and the second component storage portion 32 is configured to store a second component 2 of the vacuum cleaner.

The first component 1 is stored on the storage base 3 by the first component connecting portion 31, to realizing a storage of the first component 1 on the storage base 3. The second component 2 is stored on the second component storage portion 32, to realizing a storage of the second component 2 on the storage base 3. The first component 1 and the second component 2 can be accommodated on the storage base 3. Therefore, it is possible to prevent the first component 1 and the second component 2 from being placed randomly and disorderly, which is beneficial to saving a storage space. Meanwhile, it is also possible to prevent the first component 1 and the second component 2 from being lost due to no connection after being disassembled.

Figure 7:
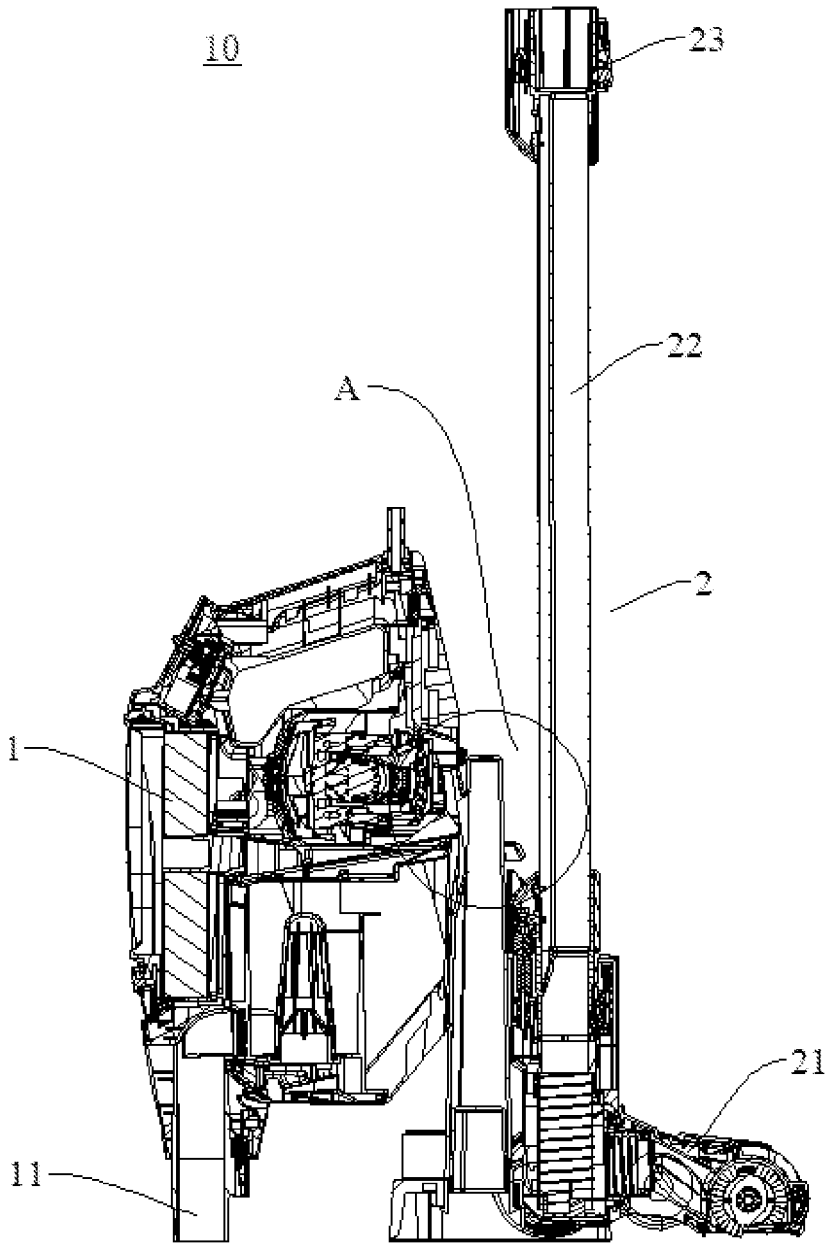
FIG. 7 is a schematic view of a main body of a vacuum cleaner and a floor brush assembly stored on the storage base.

As illustrated in FIG. 7, the second component storage portion 32 and the first component connecting portion 31 are staggered with each other in a circumferential direction of the storage base 3. In this way, a storage space of the second component 2 is staggered with a storage space of the first component 1, and thus the second component 2 and the first component 1 would not interfere with each other, which is convenient for storing components of larger volume.

In the storage base 3 according to the embodiments of the present disclosure, the first component connecting portion 31 and the second component storage portion 32 are arranged on the storage base 3. In this way, the first component 1 and the second component 2 of the vacuum cleaner can be accommodated on the storage base when the vacuum cleaner is not used, and the first component connecting portion 31 and second component storage portion 32 are staggered with each other, which is convenient for storing the components of larger volume.

As illustrated in FIG. 1, the storage base 3 includes a storage base body 34 and a storage base pillar 35 disposed on and located above the storage base body 34. The storage base body 34 and the storage base pillar 35 form an inverted T-shaped structure, which is beneficial to improving a placement stability of the storage base 3. The second component storage portion 32 is disposed on the storage base body 34, and the second component 2 can be more stably stored on the storage base 3. The first component connecting portion 31 is disposed on the storage base pillar 35, and the first component connecting portion 31 has a distance from a floor to meet a requirement of the first component 1 for the storage space.

The second component storage portion 32 and the first component connecting portion 31 are arranged on opposite sides of the storage base pillar 35 in a circumferential of the storage base pillar 35, which is conducive to maintaining a balance of forces on both sides of the storage base 3 to prevent the storage seat 3 from overturning.

The storage base 3 further includes a support locking member 33 provided thereon. The support locking member 33 is located above the second component storage portion 32.

Figure 5:
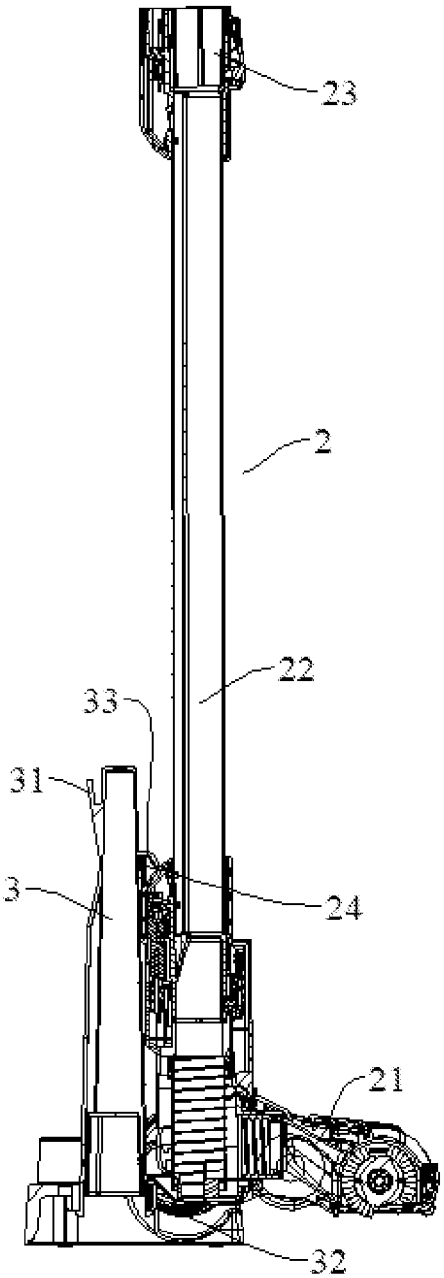
FIG. 5 is a schematic view of an engagement of a component locking member of a floor brush assembly with a support locking member of a storage base.
Figure 6:
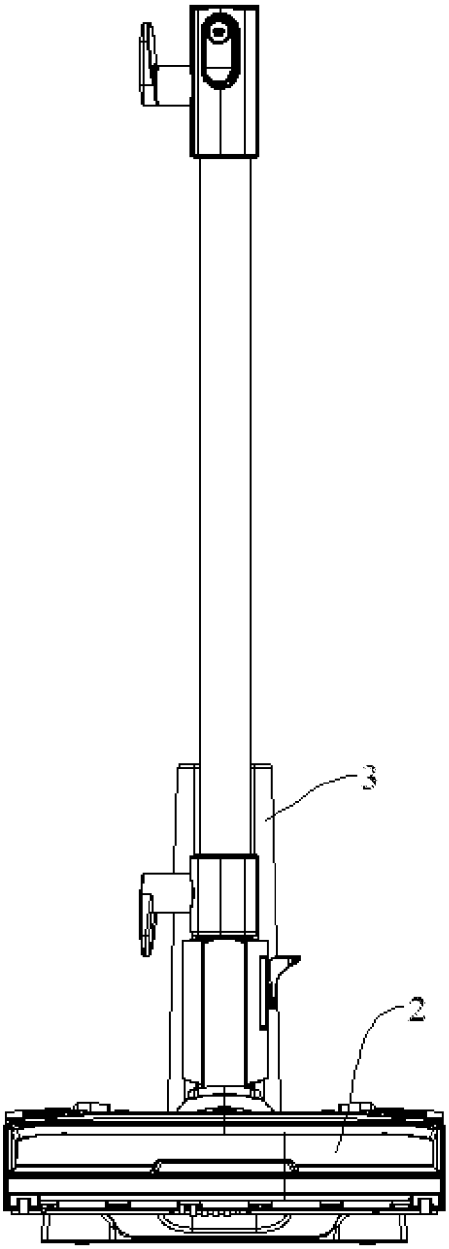
FIG. 6 is a right side view of FIG. 5.

Further, as illustrated in FIG. 1, FIG. 3, FIG. 4, and FIG. 7 to FIG. 9, the second component 2 has a component locking member 24 provided thereon. When the second component 2 is stored in the second component storage portion 32, the support locking member 33 is located above the component locking member 24. Further, as illustrated in FIG. 5 and FIG. 6, the component locking member 24 is adapted to be engaged with the support locking member 33 in response to the second component 2 being lifted upwards. At this time, the first component 1 is still stored on the storage base 3 by the first component connecting portion 31. Therefore, the storage base 3, the second component 2, and the first component 1 can be lifted as a whole through lifting the second component 2 by a user, thus easily moving the storage base 3, the second component 2, and the first component 1 as a whole.

In one embodiment, the support locking member 33 is a wedge-shaped locking member matching with the component locking member 24 in shape. The wedge-shaped structure can provide a guiding to facilitate a better engagement of the component locking member 24 and the support locking member 33.

Figure 3:
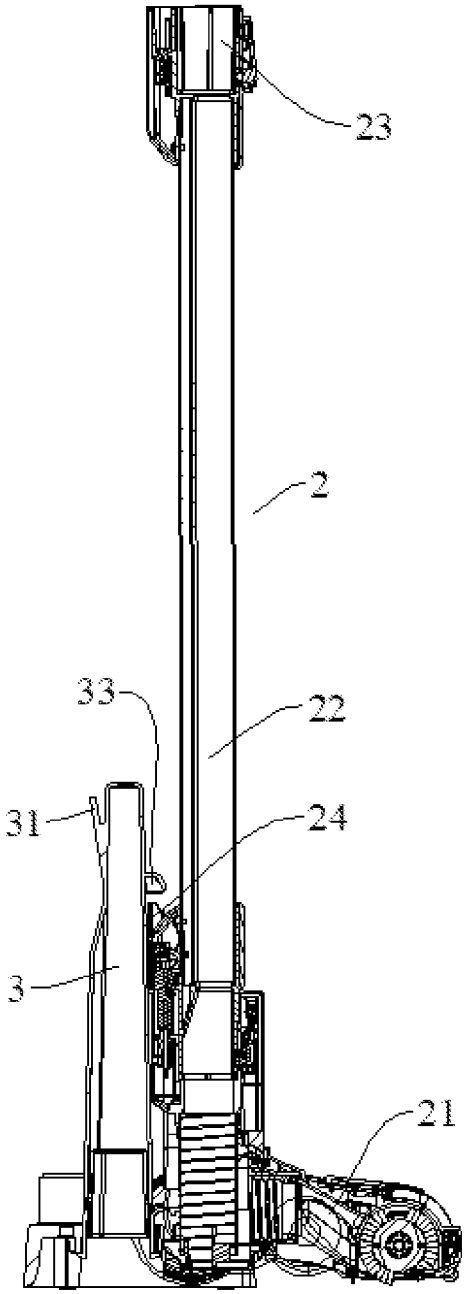
FIG. 3 is a schematic view of a floor brush assembly stored in a floor brush storage portion.
Figure 4:
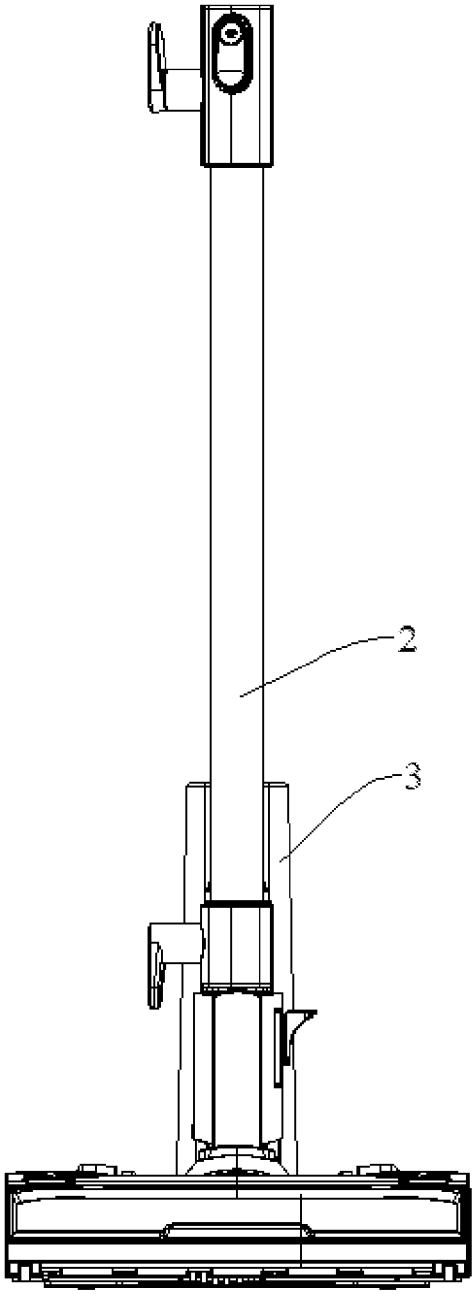
FIG. 4 is a right side view of FIG. 3.

Referring to FIG. 1, FIG. 3, and FIG. 7, the second component storage portion 32 is formed into a concave surface recessed downwards, in which the second component 2 is at least partially located.

Figure 8:
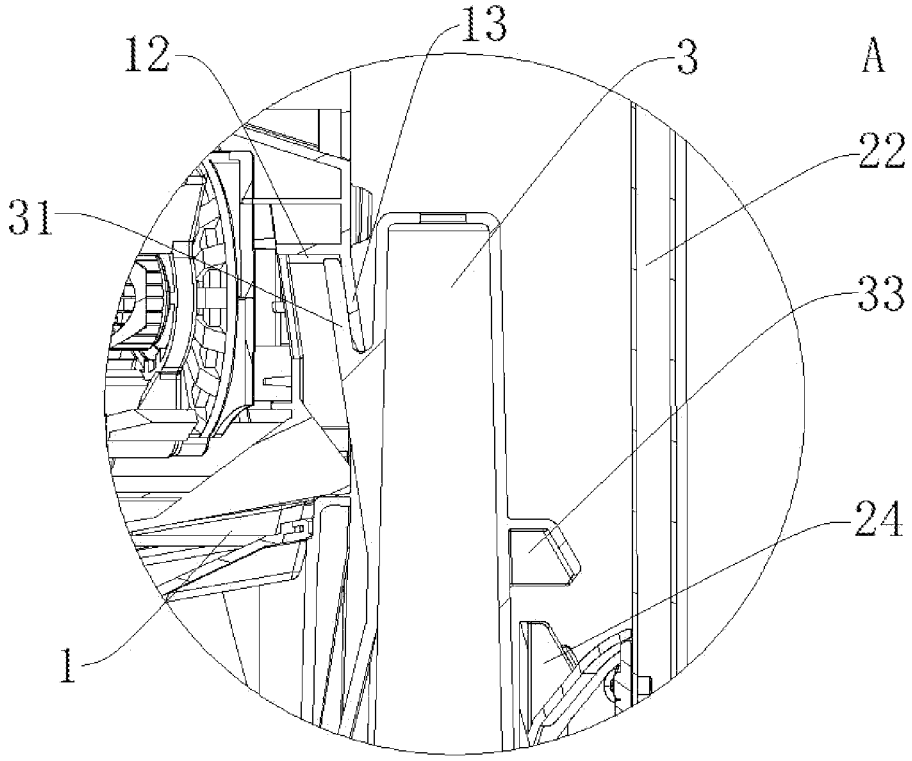
FIG. 8 is a schematic enlarged partial view of part A in FIG. 7.
Figure 9:
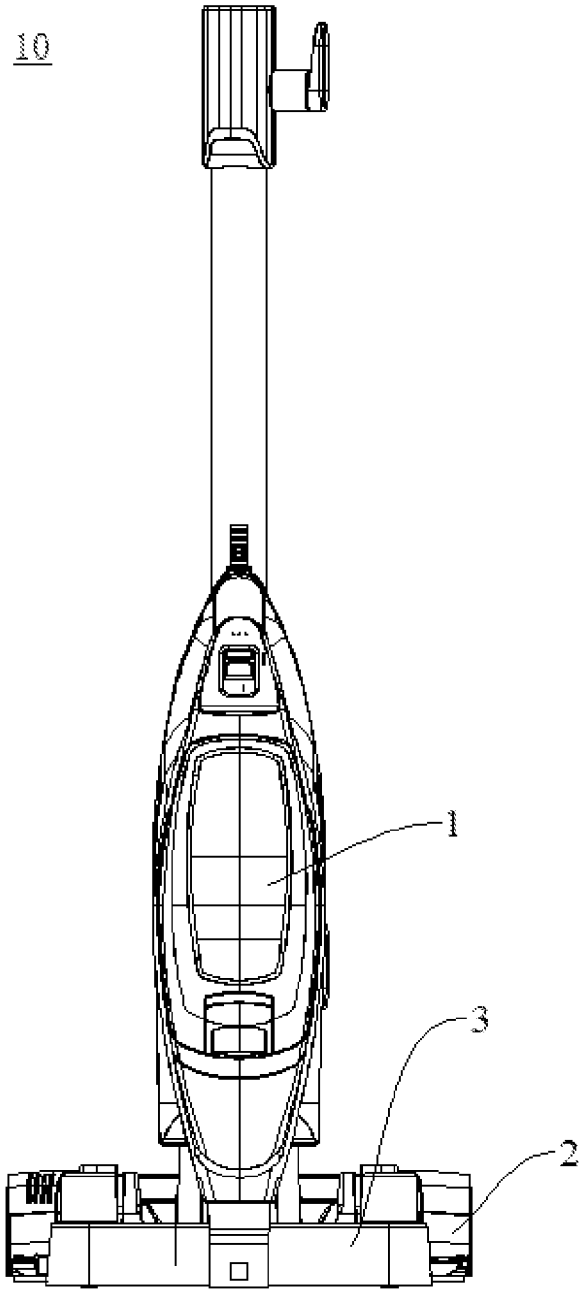
FIG. 9 is a left side view of FIG. 7.

Referring to FIG. 7 and FIG. 8, the first component connecting portion 31 is formed as an insertion pin. The first component 1 has a support arm 13 provided thereon. A groove 12 is formed between the support arm 13 and a main body of the first component 1, and the insertion pin is adapted to be inserted into the groove 12.

In one embodiment, the insertion pin extends obliquely upwards. An opening of the groove 12 faces obliquely downwards. In this way, when the first component 1 is not required to be used, the first component 1 can be hung on the insertion pin from top to bottom, and when the first component 1 is required to be used, the first component 1 can be taken down from the storage base 3 by directly lifting the first component 1, which conforms to the user's operating habits.

The vacuum cleaner may be a hand-held vacuum cleaner or other vacuum cleaners. Taking the hand-held vacuum cleaner as an example, the first component 1 is a cleaner main body 1, the second component 2 is a floor brush assembly 2, the first component connecting portion 31 is a main body connecting portion 31, and the second component storage portion 32 is a floor brush storage portion 32.

The cleaner main body 1 has a motor, a filter, a dust cup, and other components provided therein. The motor is configured to provide a suction force, the filter is configured to provide filtering, and the dust cup is configured to collect sucked dust and the like. The floor brush assembly 2 is adapted to be in direct contact with a surface to be cleaned, and the storage base 3 is configured to store the cleaner main body 1 and the floor brush assembly 2.

The floor brush assembly 2 is detachably connected to the cleaner main body 1. That is, the floor brush assembly 2 can be connected to the cleaner main body 1 when the vacuum cleaner needs to perform a cleaning task, and the floor brush assembly can be detached from the cleaner body 1 when the vacuum cleaner does not need in use, which facilitates the storage of the vacuum cleaner.

The cleaner main body 1 is stored on the storage base 3 by the main body connecting portion 31, to realizing a storage of the cleaner main body 1 on the storage base 3. The floor brush assembly 2 is stored on the floor brush storage portion 32, to realizing a storage of the floor brush assembly 2 on the storage holder 3. In this way, the floor brush assembly 2 and the cleaner main body 1 can be accommodated on the storage base 3. Therefore, it is possible to prevent the floor brush assembly 2 and the cleaner main body 1 from being placed randomly and disorderly, which is beneficial to saving the storage space. Meanwhile, it is possible to prevent the floor brush assembly 2 and the cleaner main body 1 from being lost due to no connection after being disassembled.

As illustrated in FIG. 1 to FIG. 4 and FIG. 7 to FIG. 9, the second component storage portion 32 is configured into a floor brush concave surface matching with the floor brush assembly 2, and a portion of the floor brush assembly 2 is adapted to be received in the floor brush concave surface to avoid a random shaking of the floor brush assembly 2.

Specifically, as illustrated in FIG. 1 and FIG. 7, the floor brush assembly 2 includes a floor brush body 21 and an extension pipe 22. The extension pipe 22 has a suction channel formed therein, and an extension pipe coupler 23 provided at an end thereof. The cleaner main body 1 has a suction pipe 11 adapted to match with the extension pipe coupler 23. When using a vacuum cleaner assembly 10 for the cleaning task, the suction pipe 11 is connected to the extension pipe coupler 23. In this way, a suction power of the cleaner main body 1 can be supplied to the floor brush assembly 2 through the suction pipe 11, the extension pipe coupler 23, and the extension pipe 22, and a dust sucked by the floor brush assembly 2 can also be collected into the dust cup in the cleaner main body 1 through the extension pipe 22, the extension pipe coupler 23, and the suction pipe 11.

When the cleaner main body 1 is stored on the storage base 3, the suction pipe 11 is separated from the extension pipe coupler 23, and the suction pipe 11 extends downwards to avoid debris from falling into the suction pipe 11 to damage the cleaner main body 1.

Further, the suction pipe 11 is adapted to be brought into contact with a floor when each of the cleaner main body 1 and the floor brush assembly 2 is stored on the storage base. In this way, a support can be formed at the suction pipe 11 to prevent the storage base 3 from overturning due to unbalanced forces.

The floor brush body 21 is adapted to be received in the floor brush concave surface to avoid a random shaking of the floor brush body 21. In a specific embodiment, a part of the floor brush body 21 may be received in the floor brush concave surface, and another part thereof is located outside the floor brush concave surface, to position the floor brush body 21 by the concave surface, to avoid the storage base 3 from increasing in size when all the floor brush body 21 is received in the floor brush concave surface.

As illustrated in FIG. 5 and FIG. 6, the component locking member 24 is adapted to be engaged with the support locking member 33 in response to the extension pipe 22 being lifted upwards.

Referring to FIG. 1 and FIG. 7 to FIG. 9, a vacuum cleaner assembly 10 according to embodiments of the present disclosure includes a vacuum cleaner and the storage base 3 as described in the above embodiments.

The vacuum cleaner includes the cleaner main body 1 and the floor brush assembly 2 configured to be engaged with the cleaner main body 1. The floor brush assembly 2 includes the floor brush body 21 and the extension pipe 22. The storage base 3 is configured to drive, in response to a top portion of the extension pipe 22 being lifted upwards, the cleaner main body 1 to move upwards while being out of contact with the floor, to move the vacuum cleaner assembly 10 as a whole.

A method for accommodating the vacuum cleaner on the storage base 3 will be described below.

When the vacuum cleaner is not used, the extension pipe coupler 23 of the floor brush assembly 2 is detached from the suction pipe 11 of the cleaner main body 1, and the groove 12 of the cleaner main body 1 is aligned with the first component connecting portion 31 (i.e., the insertion pin) on the storage base 3, to hang the cleaner main body 1 on the storage base 3. Thereafter, the floor brush body 21 of the floor brush assembly 2 is received in the floor brush concave surface on the storage base 3, and the floor brush assembly 2 is accommodated on the storage base 3. Of course, the floor brush assembly 2 may be stored on the storage base 3 first, and then the cleaner main body 1 may be stored on the storage base 3.

When the vacuum cleaner assembly 10 needs to be moved as a whole, the extension pipe 22 is lifted upwards by the user to engage the component locking member 24 with the support locking member 33, and the extension pipe 22 drives the storage base 3 and the cleaner main body 1 to be lifted together, to move the entire vacuum cleaner assembly 10 into a target position.

In the description of this specification, descriptions with reference to the terms "an embodiment", "some embodiments", "an example", "a specific example", "some examples", etc., mean that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner. In addition, different embodiments or examples and features of different embodiments.

What is claimed is:

1. A storage base, configured to store a vacuum cleaner, the storage base comprising:

a first component connecting portion configured to store a first component of the vacuum cleaner;

a second component storage portion configured to store a second component of the vacuum cleaner, the first component connecting portion and the second component storage portion being staggered with each other in a circumferential direction of the storage base; and a support locking member located above the second component storage portion;

wherein the storage base is configured to move upwards and out of contact with a floor;

the second component has a component locking member provided thereon; and the component locking member is adapted to be engaged with the support locking member in response to the second component being lifted upwards such that the storage base moves upwards and out of contact with the floor.

2. The storage base according to claim 1, further comprising:

a storage base body, the second component storage portion being disposed on the storage base body; and a storage base pillar disposed on the storage base body, the first component connecting portion being disposed on the storage base pillar, and the second component storage portion and the first component connecting portion being arranged on opposite sides of the storage base pillar in a circumferential direction of the storage base pillar.

3. The storage base according to claim 1, wherein the support locking member is a wedge-shaped locking member matching with the component locking member in shape.

4. The storage base according to claim 1, wherein the first component connecting portion is formed as an insertion pin extending obliquely upwards, and the second component storage portion is formed as a concave surface recessed downwards.

5. The storage base according to claim 1, wherein the first component is a cleaner main body and the second component is a floor brush assembly, the floor brush assembly being detachably connected to the cleaner main body, and wherein the second component storage portion is formed as a floor brush concave surface matching with the floor brush assembly.

6. The storage base according to claim 5, wherein the floor brush assembly comprises a floor brush body and an extension pipe, wherein the cleaner main body has a suction pipe adapted to match with the extension pipe, and wherein the suction pipe extends downwards when the cleaner main body is stored on the storage base.

7. The storage base according to claim 6, wherein the suction pipe is adapted to be brought into contact with the floor when each of the cleaner main body and the floor brush assembly is stored on the storage base.

8. A vacuum cleaner assembly, comprising a vacuum cleaner, and the storage base according to claim 1.

9. The vacuum cleaner assembly according to claim 8, wherein the vacuum cleaner comprises:

a cleaner main body; and a floor brush assembly configured to be engaged with the cleaner main body, the floor brush assembly comprising a floor brush body and an extension pipe, wherein the storage base is configured to drive, in response to a top portion of the extension pipe being lifted upwards, the cleaner main body to move upwards while being out of contact with the floor.

* * * * *